US005762287A

United States Patent [19]

Schutz

[11] Patent Number: 5,762,287

[45] Date of Patent: Jun. 9, 1998

[54] CENTER PULL TOWEL DISPENSER WITH TOWEL TRANSFER MECHANISM

[75] Inventor: Rudolph W. Schutz, Ft. Bragg, Calif.

[73] Assignee: Perrin Manufacturing Company, City of Industry, Calif.

[21] Appl. No.: 902,760

[22] Filed: Jul. 30, 1997

[51] Int. Cl.[6] ..... B65H 23/06

[52] U.S. Cl. ..... 242/593; 242/560

[58] Field of Search ..... 242/593, 560, 242/560.1

[56] References Cited

U.S. PATENT DOCUMENTS 3,294,329 12/1966 Tucker et al. ..... 242/597.8
3,381,909 5/1968 Tucker et al. ..... 242/597.8
5,219,126 6/1993 Schutz .
5,265,816 11/1993 Collins ..... 242/560
5,645,244 7/1997 Moody ..... 242/560

*Primary Examiner*—John P. Darling
*Attorney, Agent, or Firm*—Thomas R. Lampe

[57] ABSTRACT

Dispenser apparatus for sequentially dispensing sheet material from two center pull coreless rolls of sheet material disposed side-by-side includes a housing and a support within the housing for supporting the two coreless rolls on end and side-by-side. Two dispenser nozzles are incorporated in the apparatus, one nozzle for each roll. A closure member is mounted on the housing to enable only one roll at a time to be manually accessed for dispensing.

10 Claims, 11 Drawing Sheets

CENTER PULL TOWEL DISPENSER WITH TOWEL TRANSFER MECHANISM

TECHNICAL FIELD

This invention relates to dispenser apparatus for sequentially dispensing sheet material from two center pull coreless rolls. The teachings of the invention are particularly applicable to the dispensing of paper toweling from coreless paper towel rolls.

BACKGROUND OF THE INVENTION

Dispensers utilized to dispense paper toweling from coreless rolls thereof are known in the art. Such rolls include a lead end and a tail end. In center pull dispenser constructions the lead end of the toweling is pulled from the center of the roll through an opening in the dispenser, typically an opening in the dispenser bottom. A dispenser element, typically a nozzle, is disposed at the dispenser bottom defining a passageway through which the toweling is pulled and which provides for or facilitates removal of individual sheets of toweling by the consumer.

While many arrangements are known in the prior art for effecting automatic transfer between depleted rolls of paper toweling or tissue and full rolls, such transfer mechanisms are normally employed to effect automatic transfer between rolls having cores, i.e., paper towel and toilet tissue rolls of conventional type. Such mechanisms are often characterized by their relative complexity and high cost and do not readily lend themselves to use with coreless center pull rolls.

U.S. Pat. No. 5,219,126, issued Jun. 15, 1993, discloses a dispenser for automatically initiating dispensing from a reserve coreless center pull paper roll in response to depletion of a primary coreless center pull paper roll. However, in such prior art dispenser, the coreless rolls are positioned such that one of the rolls is located over the other of the rolls. Both rolls are dispensed through a single truncated conelike dispenser element projecting downwardly from the bottom wall of the dispenser housing. The lead end of the reserve roll is connected to the tail end of the primary roll to provide for automatic transfer. Use of a single dispenser element results in a high rate of wear. Furthermore, the over and under configuration of the rolls complicates servicing of the dispenser.

As will be seen in greater detail below, in contrast to the approach disclosed in U.S. Pat. No. 5,219,126, the apparatus of the present invention dispenses from two center pull coreless rolls located side-by-side with each roll being associated with its own dispenser element or nozzle. The invention is characterized by its relative simplicity and low expense and by its ease and reliability of use. An attendant can readily and quickly service the dispenser apparatus to replace a roll which has been depleted with a full roll without disturbing the roll in service, the full roll then serving as the reserve roll. Since two nozzles are employed, operative longevity of the dispenser apparatus is increased.

DISCLOSURE OF INVENTION

The present invention relates to a dispenser apparatus for sequentially dispensing sheet material from two center pull coreless rolls of sheet material disposed side-by-side, each coreless roll of sheet material including a lead end and a tail end.

The dispenser apparatus includes a housing defining a housing interior and including a housing bottom.

Support means is disposed within the housing interior above the housing bottom having an upper support surface for supporting a first coreless roll of sheet material on end at a first location and for supporting a second coreless roll of sheet material on end at a second location with the first and second coreless rolls of sheet material disposed side-by-side.

A first dispenser element is located below the upper support surface of the support means within the housing and above the housing bottom. The first dispenser element defines a passageway for receiving the lead end of a first coreless roll of sheet material supported on end by the support means at the first location.

A second dispenser element is located below the upper support surface of the support means within the housing and above the housing bottom. The second dispenser element defines a passageway for receiving the lead end of a second coreless roll of sheet material supported on end by the support means at the second location.

The dispenser apparatus also includes a closure member selectively movably mounted on the housing and movable along a path of movement between a first closure position wherein manual access to the first dispenser element through the housing bottom to pull the tail end of sheet material projecting therefrom is permitted and manual access through the housing bottom to the second dispenser element and a tail end of sheet material projecting therefrom is substantially prevented and a second closure position wherein manual access to the second dispenser element through the housing bottom to pull the tail end of sheet material projecting therefrom is permitted and manual access through the housing bottom to the first dispenser element and a tail end of sheet material projecting therefrom is substantially prevented.

The dispenser apparatus also includes lock means for locking the closure member against movement along the path of movement between said closure positions.

Lock deactivating means is cooperable with the lock means for deactivating the lock means to allow movement of the closure member between the closure positions along the path of movement responsive to depletion of a coreless roll supported by the support means.

Other features, advantages, and objects of the present invention will become apparent with reference to the following description and accompanying drawings.

MODES FOR CARRYING OUT THE INVENTION

Figure 1A:
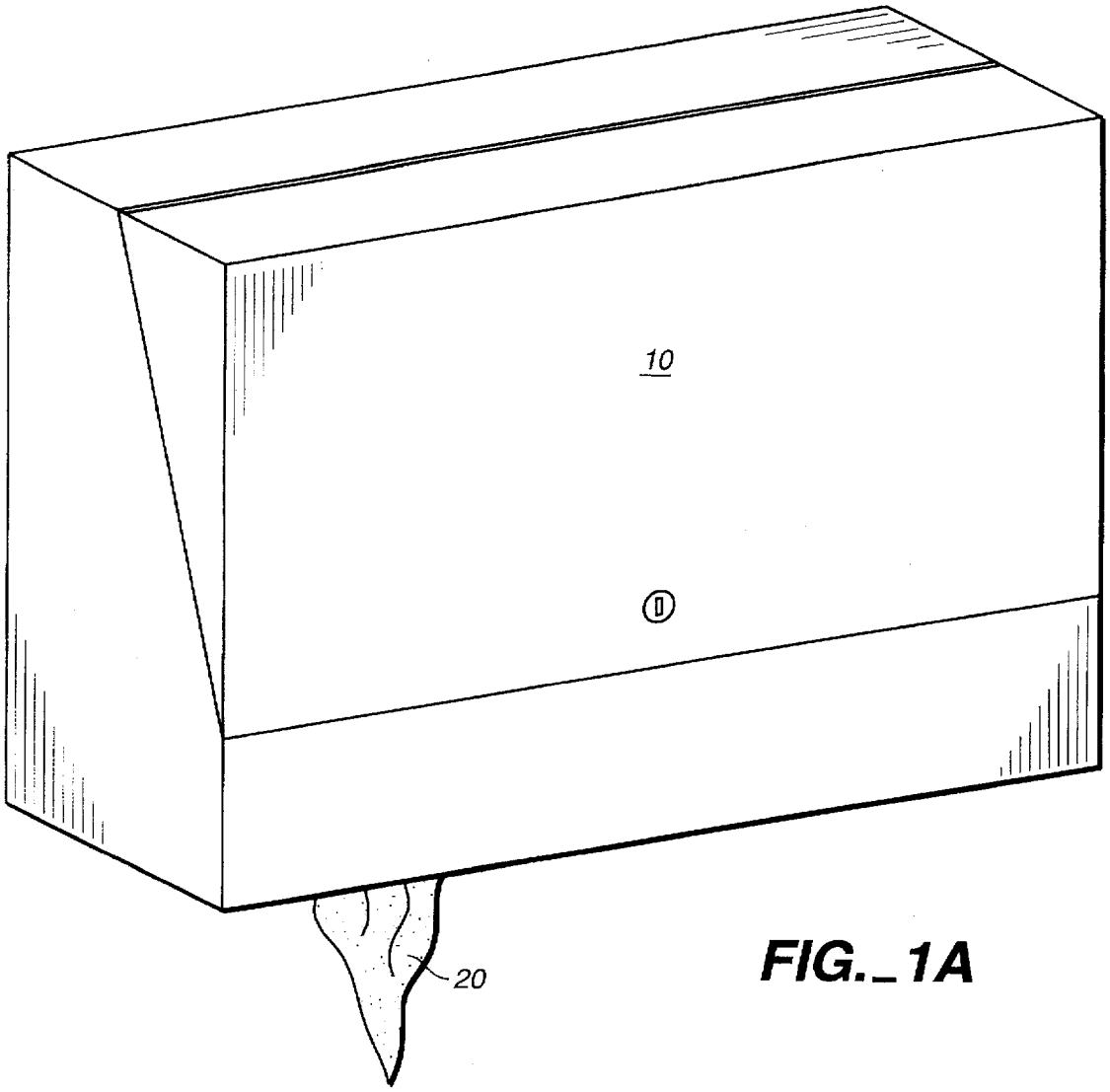
FIG. 1A is a perspective view of the housing of dispenser apparatus constructed in accordance with the teachings of the present invention illustrating a coreless roll lead end projecting from the bottom thereof.
Figure 1C:
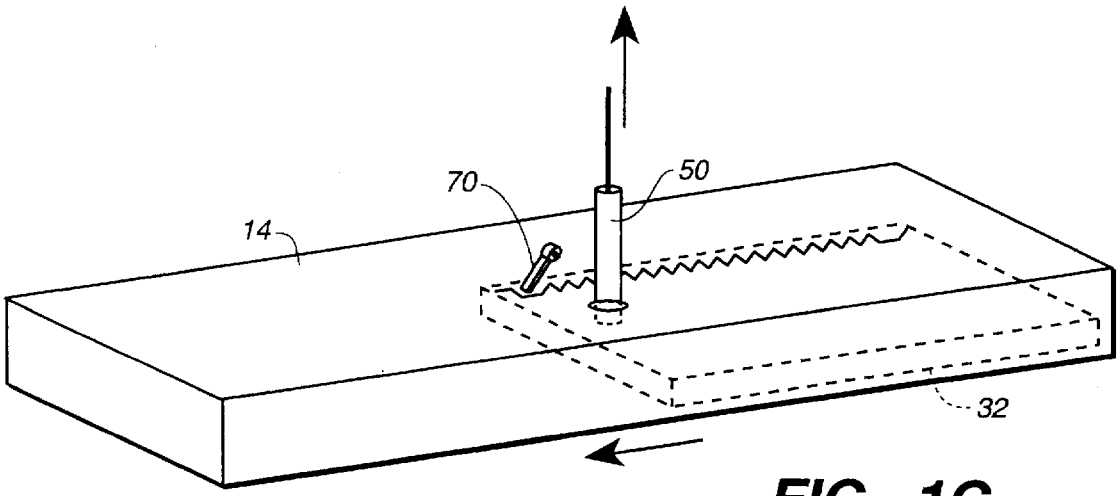
FIG. 1C is a diagrammatic perspective view of the support, the lock member and ratchet mechanism employed to control movement of a closure member employed in the apparatus.

Referring now to FIGS. 1A through 3D, a preferred embodiment of the invention is illustrated. The dispenser apparatus includes a housing 10 defining a housing interior and including a housing bottom 12. Disposed within the housing interior above the bottom 12 is a support 14 having an upper support surface for supporting two coreless rolls of sheet material on end and disposed side-by-side. FIGS. 1B, 2A and 2D illustrate two such rolls, rolls 16 and 18. The illustrated rolls are rolls of paper toweling and each roll has a lead end 20 projecting downwardly from the center of the roll and a tail end 22 comprising the terminal end of the outer convolution of the roll. In FIGS. 1B and 2A, the roll 16 is the primary roll from which dispensing of toweling is occurring and roll 18 is the reserve roll from which dispensing will occur when roll 16 is depleted. In FIG. 2D the roll 18 is the primary roll and roll 16 is the reserve roll.

Projecting downwardly from the support 14 at spaced locations corresponding to the centers of the rolls are dispenser elements or nozzles 24, 26. In the illustrated embodiment the nozzles 24, 26 are of identical configuration. More particularly, each of the dispenser elements or nozzles has a truncated cone-like configuration defining an interior passageway which diminishes in size in a downward direction. This nozzle configuration is well known in the center pull coreless towel dispensing art. A round hole with a serrated edge may be provided here to dispense non-perforated tissue. This is well known.

Located below the nozzles 24, 26 just above the housing bottom 12 is a channel 30 which defines a linear path of movement for a slidable closure member 32. The closure member 32 is movable between the closure position shown in FIGS. 1B and. 2A wherein the closure member is under dispenser element 26 and the position shown in FIG. 2D wherein the closure member 32 is under dispenser element 24. It will be appreciated that manual access cannot be had to the particular nozzle covered by the closure member through the bottom 12 of the housing 10. On the other hand, manual access is available through the housing bottom to the nozzle and towel lead end projecting therefrom which is not covered by the closure member. That is, one wishing to remove a length of paper towel can only do so from one roll at a time. In the disclosed embodiment of the invention manual access through the housing bottom 12 is had through bottom openings 40, 42.

Figure 1B:
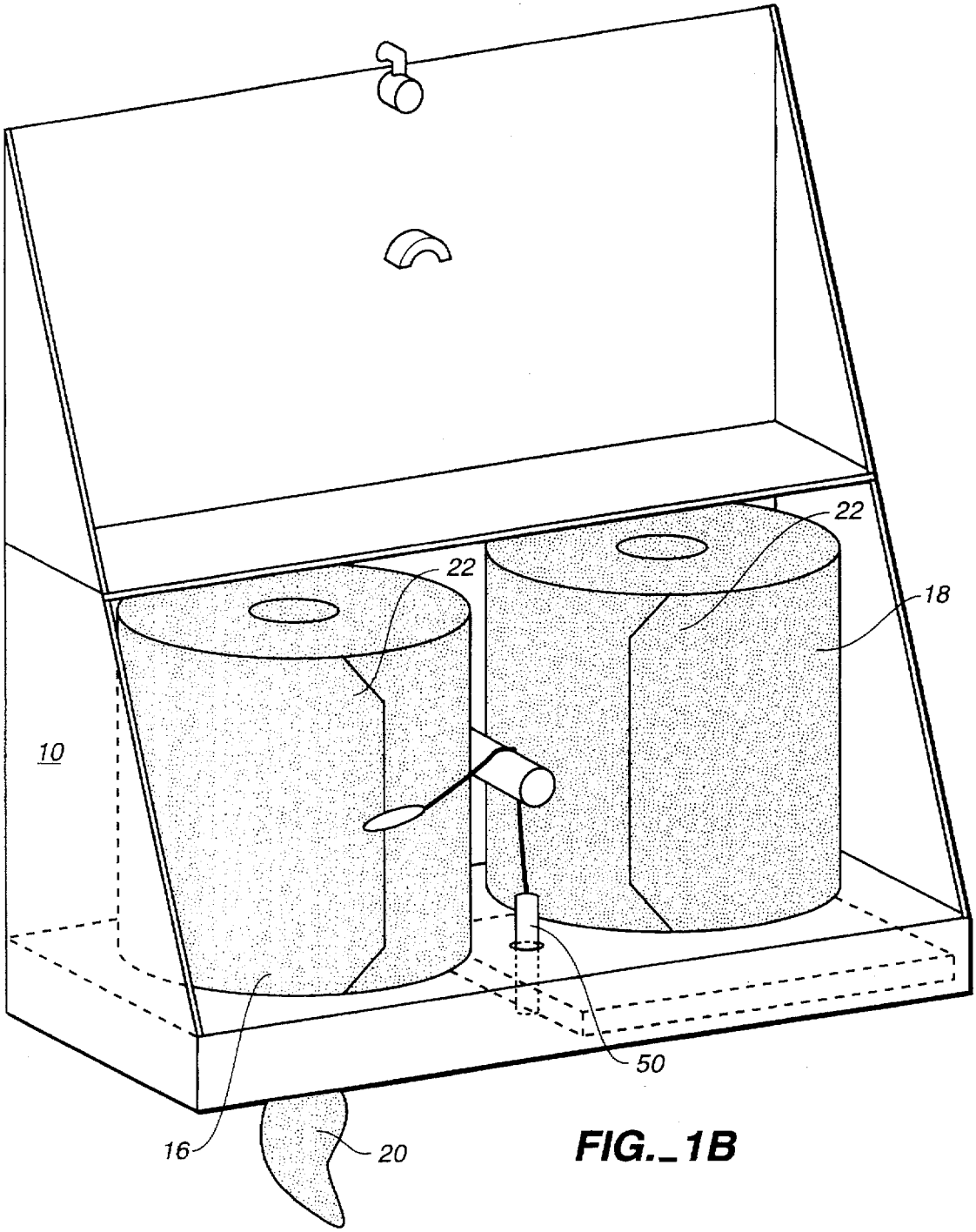
FIG. 1B is a perspective view illustrating the housing opened and two center pull coreless rolls of sheet material disposed side-by-side on a support employed in the dispenser apparatus, the tail end of one of the rolls connected to a locking member.
Figure 2A:
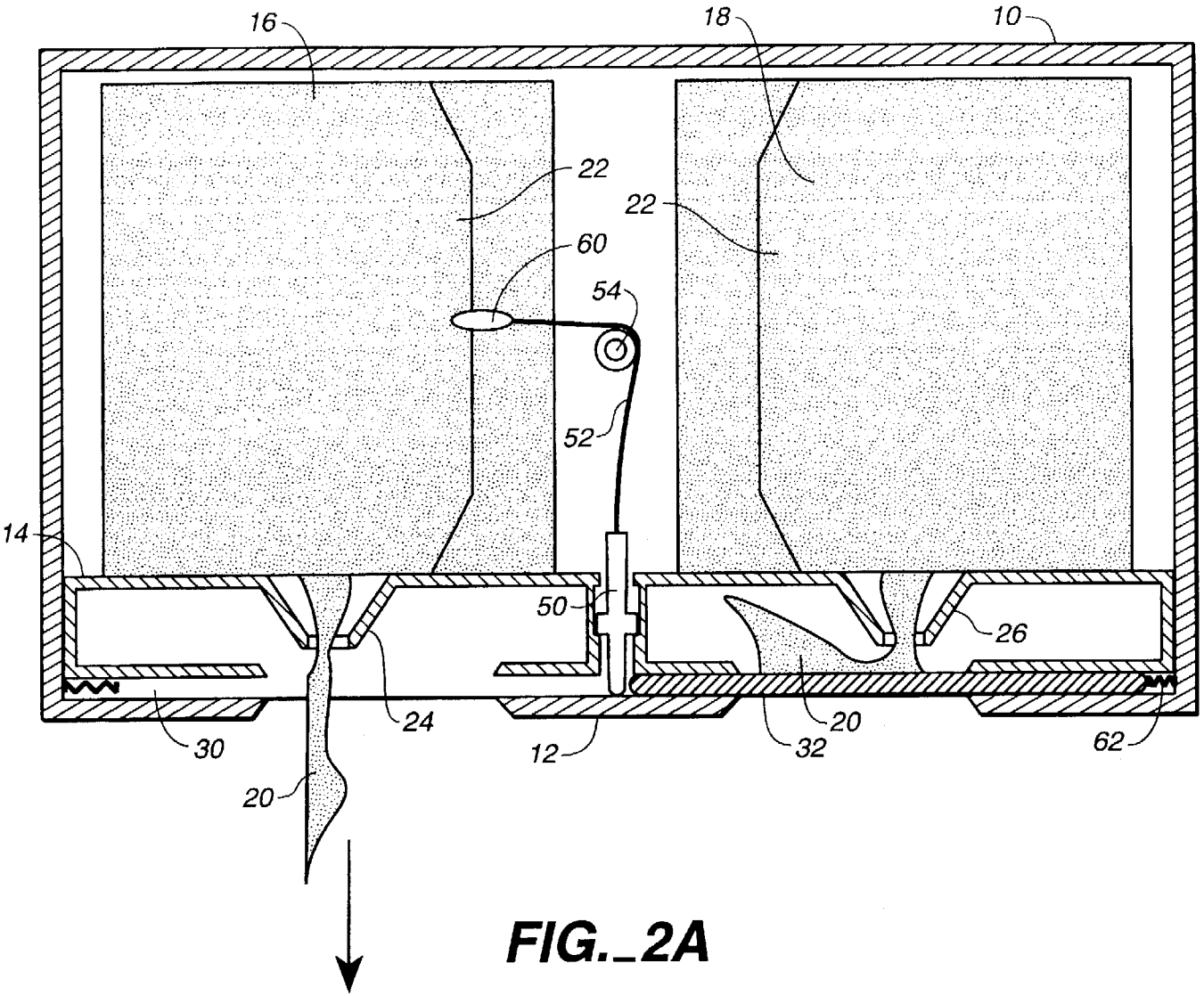
FIG. 2A is a cross-sectional elevational view of the apparatus with two coreless rolls and illustrating toweling being dispensed from one of the rolls.

As will now be described in greater detail, the structure of the embodiment under discussion provides manual access to the tail end of a reserve roll when the primary roll is depleted. Mounted for up and down movement within the housing interior at a location substantially mid-length of the housing interior is a locking member 50. FIGS. 1B, 2A and 2D show the locking member 50 in its lower or locking position where it will abut the end of closure member 32, and FIGS. 2B and 2C show the locking member 50 in its upper position where it will not block movement of the closure member.

Normally the locking member 50 is in its lower or closure member movement locking position, being urged to such position by the force of gravity or spring loading.

Attached to locking member 50 and projecting upwardly therefrom is structure for deactivating the lock member by raising the lock member when one of the rolls in the dispenser apparatus housing is depleted. More particularly, an elongated flexible cord 52 projects upwardly from the locking member and loops over a cord support 54. Attached to the distal end of the cord 52 is a clamp 60 of any suitable construction which attaches the cord to the roll tail end. In FIGS. 1B and 2A the clamp is attached to the tail end of roll 16, the primary roll.

Figure 2B:
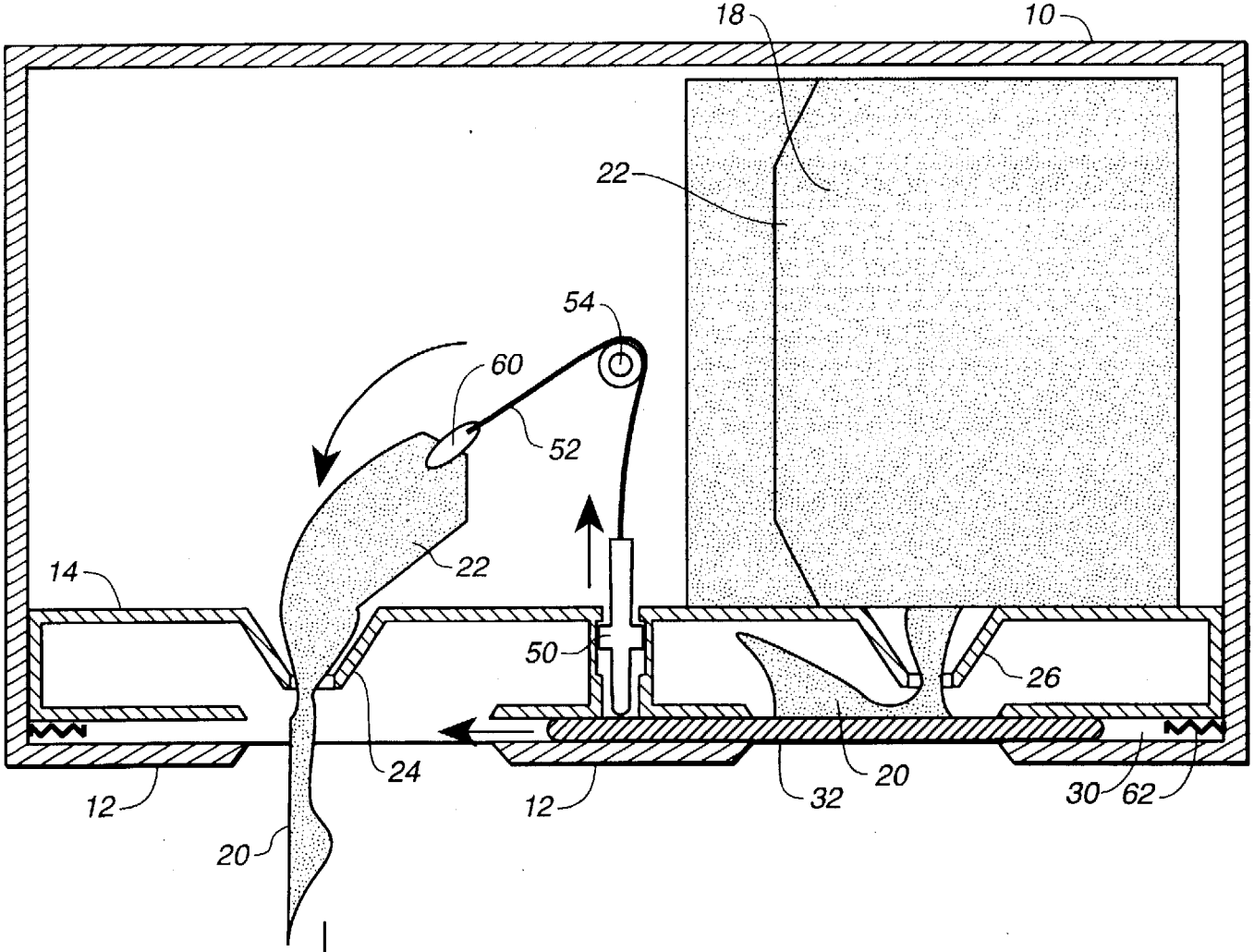
FIG. 2B is a view similar to FIG. 2A but illustrating depletion of the dispensed roll and deactivation of a locking member controlling movement of the closure member.
Figure 2C:
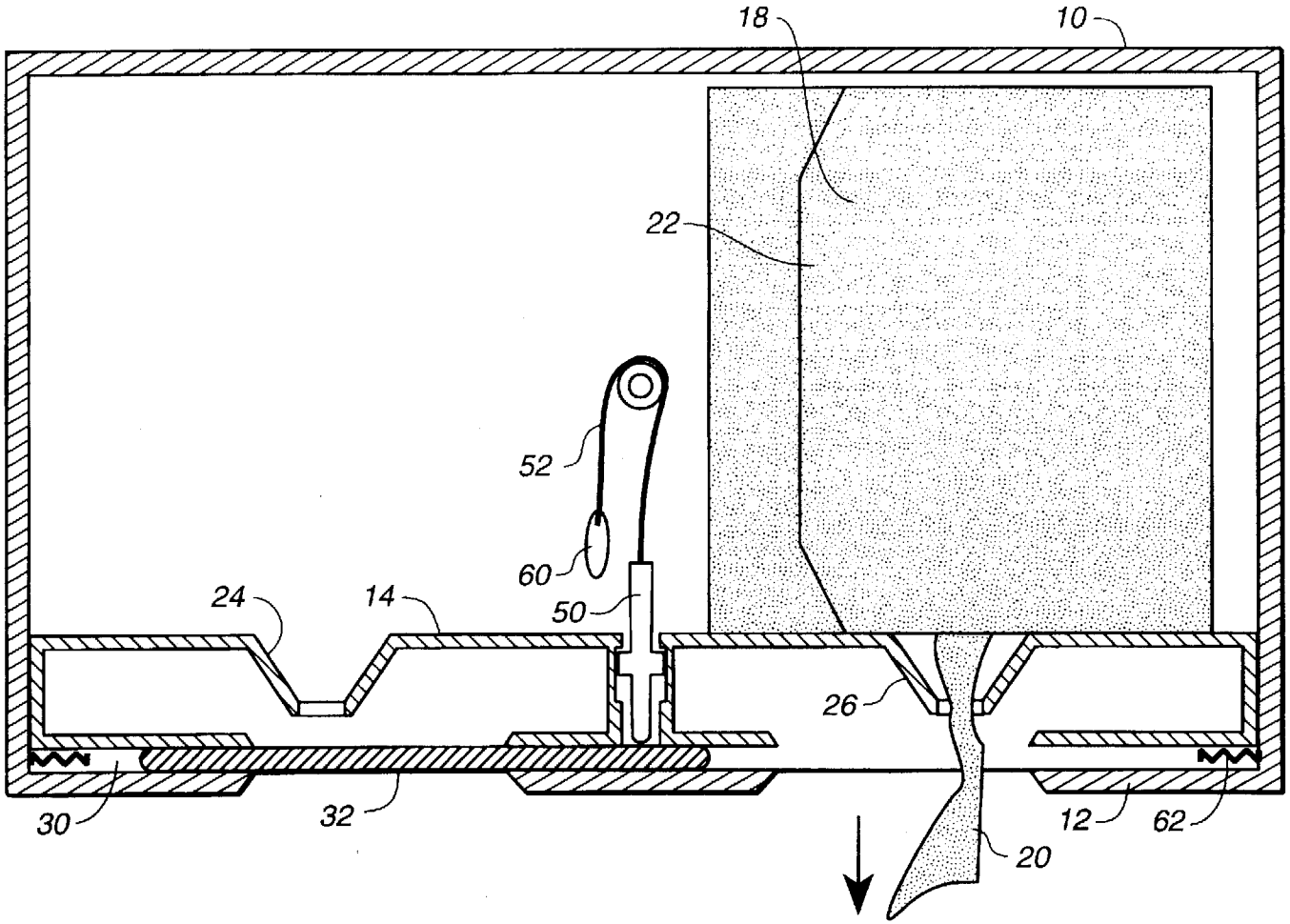
FIG. 2C is a view similar to FIG. 2A but illustrating one of the rolls having been completely depleted and the closure member having been moved from one position to another upon deactivation of the locking member.
Figure 2D:
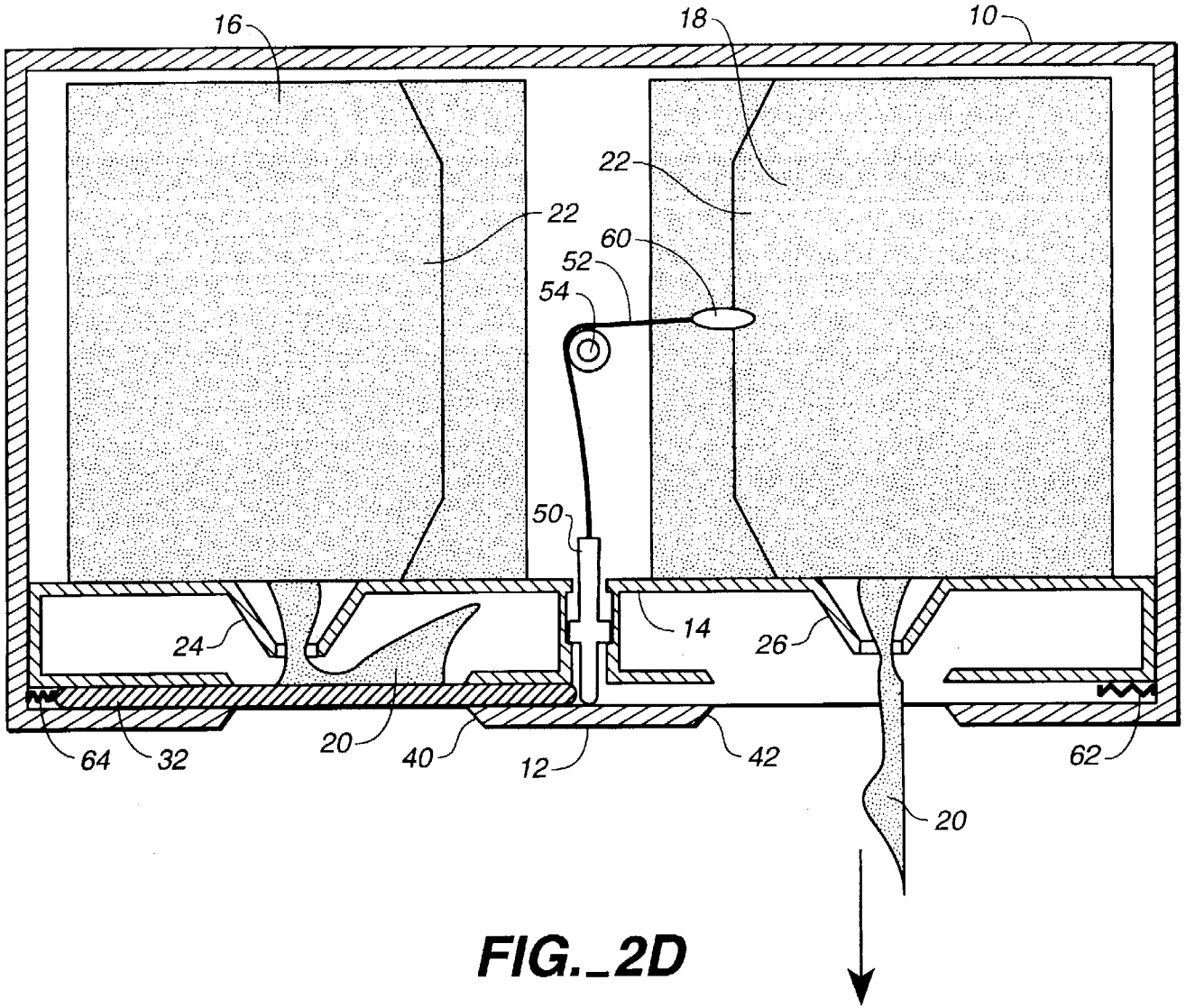
FIG. 2D is a view similar to FIG. 2A illustrating the relative positions assumed by structural elements of the dispenser apparatus after the depleted roll has been replaced by a reserve roll and the former reserve roll has become the primary roll from which dispensing of toweling takes place.

When roll 16 is depleted the tail end 18 thereof moving toward nozzle 24 will pull the cord 52, as shown in FIG. 2B, and cause locking member 50 to move out of the path of movement of closure member 32. Immediately upon such movement of the locking member the closure member will be moved to the left as viewed in FIG. 2B by a compression spring 62 which has been under compression until depletion of roll 16.

After the roll 16 has been fully depleted the clamp 60 will have torn away from the tail end of the depleted roll and will assume the position shown in FIG. 2C. The lead end 20 of roll 18 will now be readily accessible by a consumer.

An attendant will replace the depleted roll with a new roll 16 as shown in FIG. 2D. The attendant also clamps the clamp 60 to the tail end 22 of roll 18 which will now function as the primary roll. FIG. 2D also shows the closure member 52 in the position it occupies with roll 18 as the primary roll and roll 16 as the reserve roll. A compression spring 64 at the left end of the housing bears against the closure member and urges the closure member to the right. However, movement of the closure member to the right is blocked by the locking member and will continue to be blocked until roll 18 is depleted.

Once the closure member has been moved toward the left by compression spring 62 or to the right by compression spring 64, the direction of movement of the closure member cannot be reversed until the closure member has completed movement to one of the two closure positions, i.e., the positions shown in FIGS. 2A and 2D. This will ensure that the closure member will not inadvertently be returned to a position where it will block or impede dispensing from the primary roll.

Figure 3A:
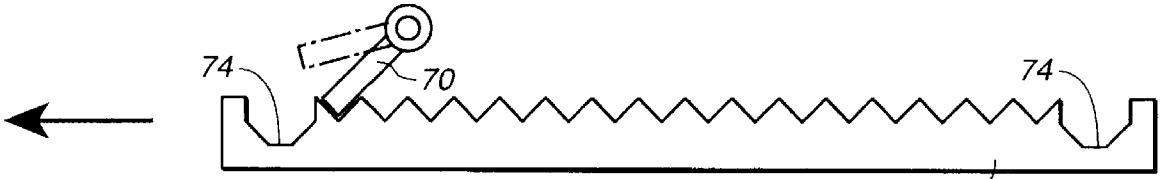
FIGS. 3A–3D are diagrammatic views illustrating operation of the components of a ratchet mechanism employed in the dispenser apparatus during sequential stages of operation of the dispenser apparatus.
Figure 3B:
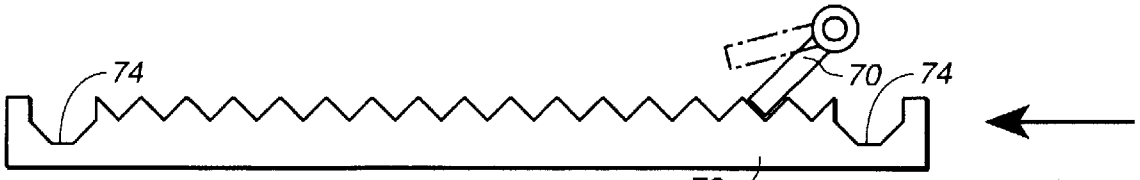
Figure 3C:
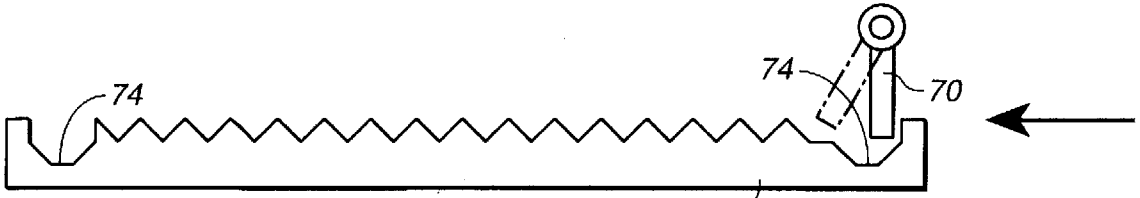
Figure 3D:
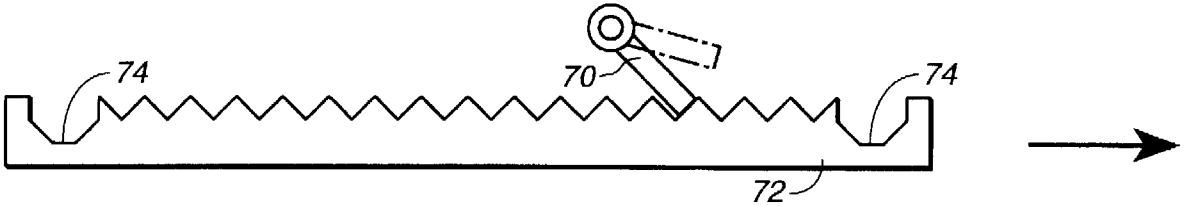

The mechanism for accomplishing this is a ratchet mechanism including a pawl 70 which engages teeth on an elongated ratchet member 72 extending along the length of closure member 32 at the back side thereof. FIGS. 3A–3D illustrate the cooperative relationship between the pawl 70 and the ratchet member 72. Enlarged cavities 74 at the ends of ratchet member 72 enable the pawl 70 to switch orientations when the closure member 32 has completely moved to its operative closure positions. For example, when movement of the ratchet member 72 has begun toward the left as shown by the bold arrow in FIG. 3A, its movement cannot be reversed until the pawl reaches the cavity 74 at the right end of the ratchet member as shown in FIG. 3C. Then the ratchet member (and closure member) can be moved to the right as shown by the bold arrow in FIG. 3D but cannot move to the left until the cavity 74 at the left end of the ratchet member accommodates the pawl.

FIGS. 4A–5B show another and somewhat simpler embodiment of the invention. In this arrangement there is no automatic transfer between rolls.

Figure 4A:
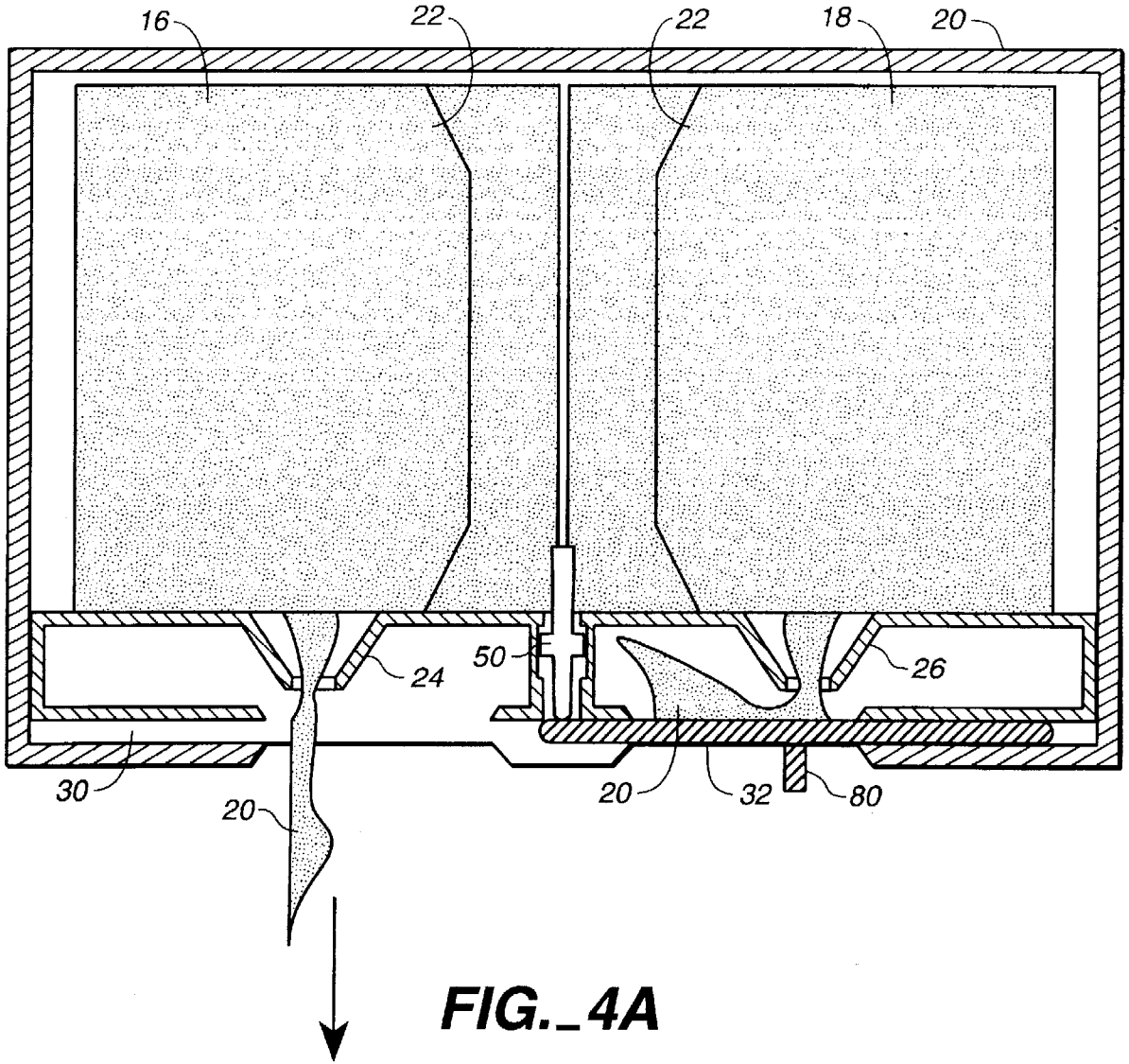
FIGS. 4A–4C are cross-sectional elevational views illustrating an alternate embodiment of the invention and further illustrating the structural components thereof in the relative positions assumed thereby during sequential stages of operation of the dispenser apparatus.
Figure 4B:
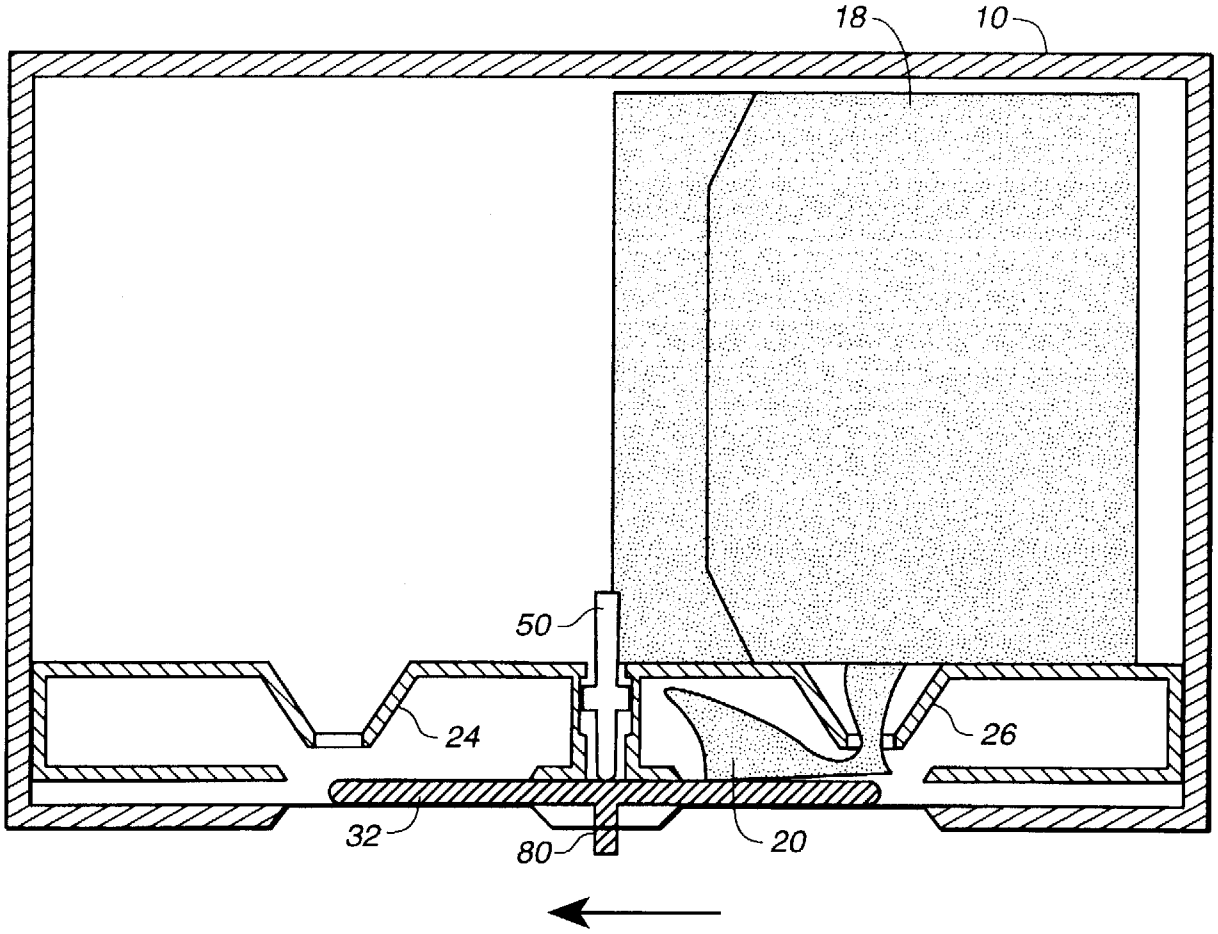
Figure 5A:
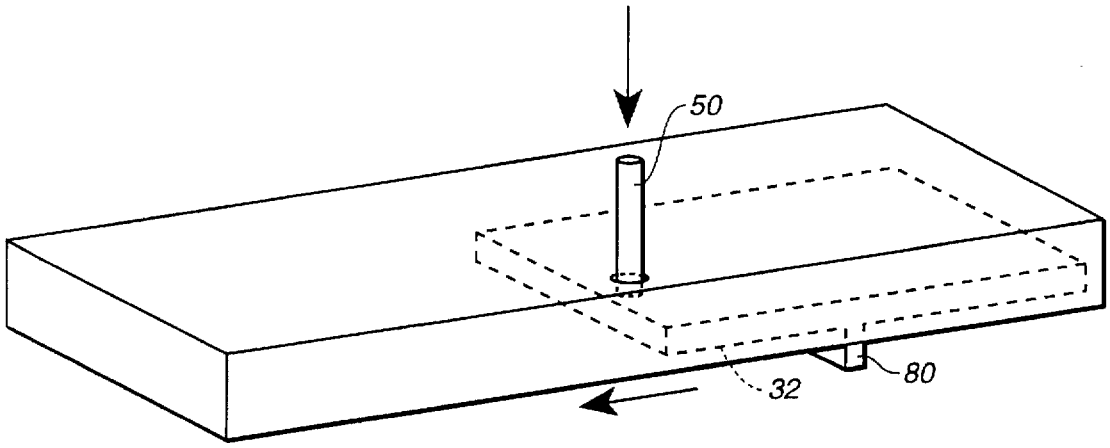
FIGS. 5A and 5B are diagrammatic perspective views illustrating operative relationships between the locking member and the closure member during sequential stages of operation of the second embodiment of the dispenser apparatus.

In FIG. 4A and 5A the locking member 50 and the closure member 32 are shown in the positions they normally occupy when dispensing is occurring from primary roll 16. The locking member rides on the top surface of the closure member and a handle 80 can be utilized to manually move the closure member to the left when one wishes to transfer to roll 18 for dispensing purposes. FIG. 4B shows the former roll 16 as completely depleted and the closure member 32 being moved to the left to uncover nozzle 26 and the lead end 20 of full roll 18.

Figure 4C:
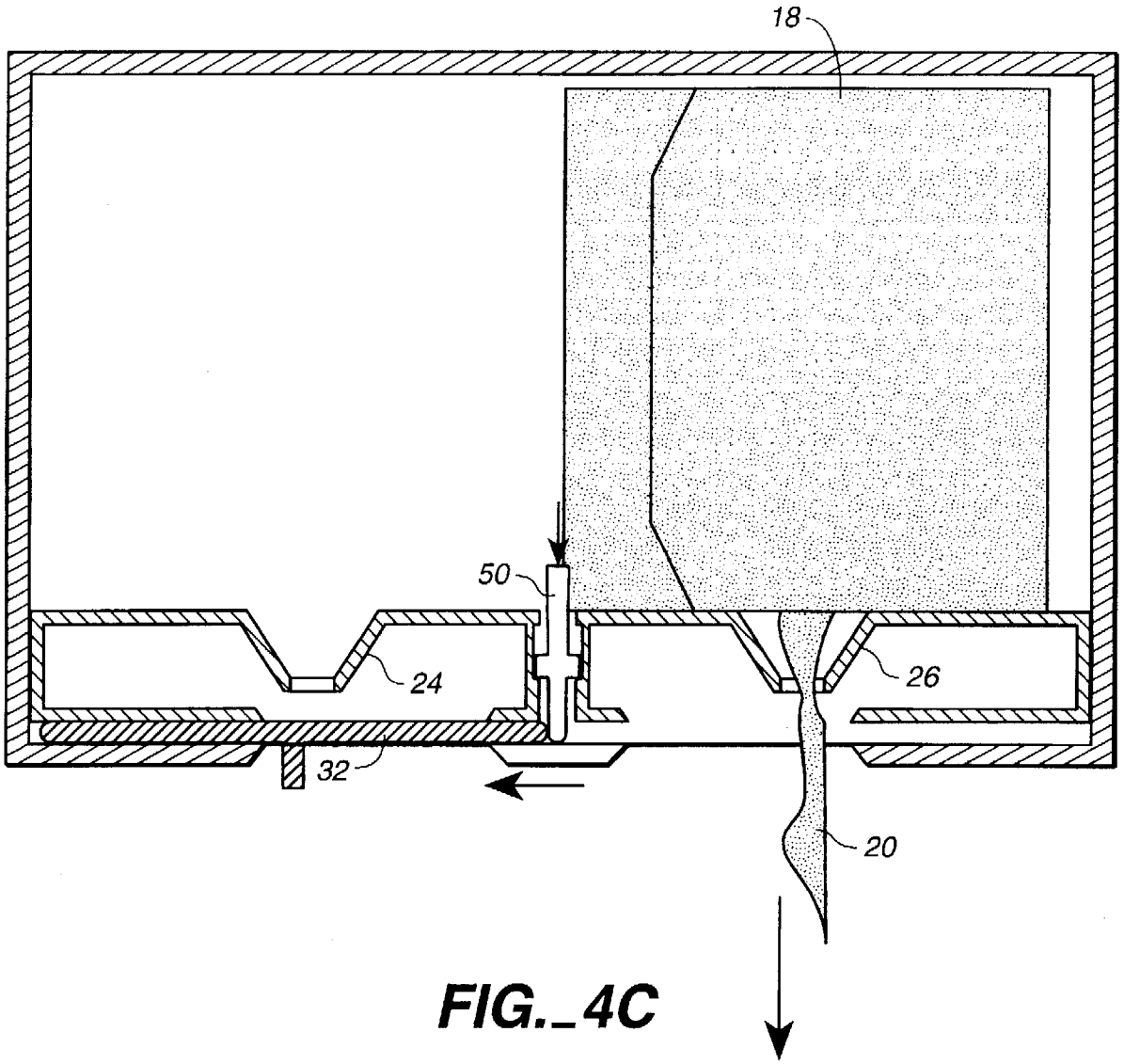
Figure 5B:
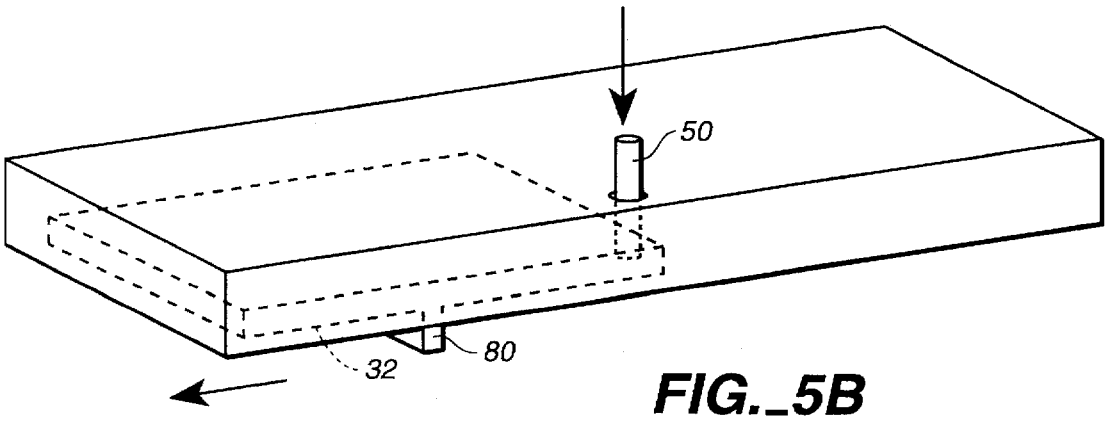

FIG. 4C shows dispensing taking place from roll 18 and the closure member completely moved to the left to block nozzle 24. FIG. 5B also shows the closure member in such position. Complete movement of the closure member 32 to the left will allow the trailing edge thereof to clear locking member 50 so that the locking member drops under the influence of gravity into the locking position shown wherein the closure member 32 will abut the locking member and prevent it from moving back toward the right until the attendant withdraws the locking member from locking position, usually when roll 16 is being replaced. At such time the closure member 32 will be moved slightly to the right by the attendant so that the locking member will be retained in its upward position by riding on the top surface of the closure member until nozzle 24 and the roll tail end projecting therefrom are to be exposed.

I claim:

1. Dispenser apparatus for sequentially dispensing sheet material from two center pull coreless rolls of sheet material disposed side-by-side, each coreless roll of sheet material including a lead end and a tail end, said dispenser apparatus comprising, in combination:

a housing defining a housing interior and including a housing bottom;

support means within said housing interior above said housing bottom having an upper support surface for supporting a first coreless roll of sheet material on end at a first location and for supporting a second coreless roll of sheet material on end at a second location with said first and second coreless rolls of sheet material disposed side-by-side;

a first dispenser element located below the upper support surface of said support means within said housing and above said housing bottom, said first dispenser element defining a passageway for receiving the lead end of a first coreless roll of sheet material supported on end by said support means at said first location;

a second dispenser element located below the upper support surface of said support means within said housing and above said housing bottom, said second dispenser element defining a passageway for receiving the lead end of a second coreless roll of sheet material supported on end by said support means at said second location; and a closure member selectively movably mounted on said housing and movable along a path of movement between a first closure position wherein manual access to said first dispenser element through said housing bottom to pull the tail end of sheet material projecting therefrom is permitted and manual access through said housing bottom to said second dispenser element and a tail end of sheet material projecting therefrom is substantially prevented and a second closure position wherein manual access to said second dispenser element through said housing bottom to said first dispenser element and a tail end of sheet material projecting therefrom is permitted and manual access through said housing bottom to said first dispenser element and a tail end of sheet material projecting therefrom is substantially prevented.

2. The dispenser apparatus according to claim 1 additionally comprising lock means for locking said closure member against movement along said path of movement between said closure positions.

3. The dispenser apparatus according to claim 2 including lock deactivating means cooperable with said lock means for deactivating said lock means to allow movement of said closure member between said closure positions along said path of movement responsive to depletion of a coreless roll supported by said support means.

4. The dispenser apparatus according to claim 3 wherein said lock means includes a locking member movable between a first locking member position wherein said locking member is located in the path of movement of said closure member and wherein said closure member abuts said locking member to prevent movement of said closure member along said path of movement and a second locking member position wherein said locking member is not located in the path of movement of said closure member and wherein said closure member is not prevented from moving along said path of movement by said locking member.

5. The dispenser apparatus according to claim 4 wherein said lock deactivating means includes interconnection means for interconnecting said locking member to the tail end of a coreless roll of sheet material supported by said support means.

6. The dispenser apparatus according to claim 5 wherein said interconnection means comprises an elongated flexible connector element extending between the locking member to the tail end of a coreless roll of sheet material supported by said support means for moving said locking member from said first locking member position to said second locking member position when the tail end of the associated coreless roll moves toward a dispenser element during dispensing of sheet material therefrom.

7. The dispenser apparatus according to claim 4 including biasing means for biasing said closure member into abutting engagement within said locking member when said locking member is in said first locking member position.

8. The dispenser apparatus according to claim 7 wherein said biasing means comprises at least one compression spring.

9. The dispenser apparatus according to claim 1 additionally comprising a ratchet mechanism operatively associated with said closure member to prevent reversal of the direction of movement of said closure member once movement of said closure member along said path of movement has been initiated until said closure member has completed movement between closure positions.

10. The dispenser apparatus according to claim 1 wherein said housing bottom defines two housing bottom openings, one of said housing bottom openings being covered by said closure member when said closure member is in first position and the other of said housing bottom openings being covered by said closure member when said closure member is in second position.

* * * * *